US011835058B2

(12) United States Patent
Honda et al.

(10) Patent No.: US 11,835,058 B2
(45) Date of Patent: Dec. 5, 2023

(54) IMPELLER AND CENTRIFUGAL COMPRESSOR

(71) Applicant: Mitsubishi Heavy Industries Marine Machinery & Equipment Co., Ltd., Nagasaki (JP)

(72) Inventors: Hironori Honda, Tokyo (JP); Nao Taniguchi, Tokyo (JP); Fumito Hiratani, Tokyo (JP); Isao Tomita, Tokyo (JP); Tetsuya Matsuo, Nagasaki (JP); Taiyo Shirakawa, Nagasaki (JP)

(73) Assignee: MITSUBISHI HEAVY INDUSTRIES MARINE MACHINERY & EQUIPMENT CO., LTD., Nagasaki (JP)

( * ) Notice: Subject to any disclaimer, the term of this patent is extended or adjusted under 35 U.S.C. 154(b) by 0 days.

(21) Appl. No.: 17/914,467

(22) PCT Filed: Apr. 21, 2021

(86) PCT No.: PCT/JP2021/016172

§ 371 (c)(1),
(2) Date: Sep. 26, 2022

(87) PCT Pub. No.: WO2021/215471

PCT Pub. Date: Oct. 28, 2021

(65) Prior Publication Data

US 2023/0123100 A1 Apr. 20, 2023

(30) Foreign Application Priority Data

Apr. 23, 2020 (JP) ..... 2020-076704

(51) Int. Cl.
*F04D 29/30* (2006.01)
*F04D 29/28* (2006.01)
(Continued)

(52) U.S. Cl.
CPC ..... *F04D 29/284* (2013.01); *F04D 17/10* (2013.01); *F04D 29/30* (2013.01); *F01D 5/048* (2013.01);
(Continued)

(58) Field of Classification Search
CPC ..... F04D 29/284; F04D 29/30; F04D 29/286; F04D 29/324; F04D 29/384;
(Continued)

(56) References Cited

U.S. PATENT DOCUMENTS 4,863,349 A * 9/1989 Arkhipov ..... F04D 29/284 416/186 R
5,395,210 A * 3/1995 Yamazaki ..... F04D 29/30 415/55.1
(Continued)

FOREIGN PATENT DOCUMENTS

JP 2002-21574 A 1/2002
JP 2014-092138 A 5/2014
(Continued)

OTHER PUBLICATIONS

International Search Report dated Jun. 1, 2021, issued in counterpart Application PCT/JP2021/016172. (9 pages).
(Continued)

*Primary Examiner* — Woody A Lee, Jr.
*Assistant Examiner* — Behnoush Haghighian
(74) *Attorney, Agent, or Firm* — WHDA, LLP

(57) ABSTRACT

An impeller includes: a disk-shaped hub centered on an axis; and a plurality of blades arranged in a circumferential direction and protruding from a surface of the hub facing one side in a direction of the axis. In a cross-sectional view including a blade height direction which is a direction away from the hub toward a tip of each blade, the blade has a recessed surface curved convexly toward a rear side in a
(Continued)

rotational direction. In the cross-sectional view, when a distance between an imaginary line connecting a tip-side edge and a hub-side edge of the blade and a midspan of the blade along a direction perpendicular to the imaginary line is defined as a recess amount, the blade has a portion where the recess amount increases from a leading edge side to a trailing edge side.

6 Claims, 8 Drawing Sheets

(51) Int. Cl.
*F04D 17/10* (2006.01)
*F01D 5/14* (2006.01)
*F01D 5/04* (2006.01)

(52) U.S. Cl.
CPC ..... *F01D 5/141* (2013.01); *F05D 2240/303* (2013.01); *F05D 2240/304* (2013.01); *F05D 2250/70* (2013.01)

(58) Field of Classification Search
CPC ..... F04D 29/242; F04D 17/122; F04D 17/10; F01D 5/141; F01D 5/048
See application file for complete search history.

(56) References Cited

U.S. PATENT DOCUMENTS 5,730,582 A * 3/1998 Heitmann ..... F04D 29/284 416/185
6,007,300 A * 12/1999 Saeki ..... F04D 29/283 416/178
6,827,555 B2 * 12/2004 Yang ..... F04D 29/30 416/243
6,877,955 B2 * 4/2005 Higashimori ..... F01D 5/14 416/185
7,063,508 B2 * 6/2006 Higashimori ..... F01D 5/04 416/185
7,517,193 B2 * 4/2009 Higashimori ..... F04D 21/00 416/185
8,096,777 B2 * 1/2012 Yokoyama ..... F01D 1/08 416/243
8,128,356 B2 * 3/2012 Higashimori ..... F01D 17/148 415/205
8,167,548 B2 * 5/2012 Greim ..... F01D 5/141 415/199.5
8,277,187 B2 * 10/2012 Schluter ..... F04D 29/284 416/185
8,517,664 B2 * 8/2013 Sun ..... F04D 29/30 416/182
8,641,382 B2 * 2/2014 Weber ..... F01D 17/165 416/237
9,157,450 B2 * 10/2015 Sugimura ..... F04D 29/284
9,777,578 B2 * 10/2017 Yokoyama ..... F01D 5/04
9,874,219 B2 * 1/2018 Saito ..... F04D 29/284
9,897,101 B2 * 2/2018 Saito ..... F04D 29/284
9,964,116 B2 * 5/2018 Watanabe ..... F04D 29/2277
10,634,157 B2 * 4/2020 Rubino ..... F04D 17/122
10,947,988 B2 * 3/2021 Yanagisawa ..... F04D 29/284
11,041,505 B2 * 6/2021 Honda ..... F02B 39/00
11,313,229 B2 * 4/2022 Yoshida ..... F01D 5/048
11,365,740 B2 * 6/2022 Masaki ..... F25B 31/026
11,525,457 B2 * 12/2022 Honda ..... F04D 29/384
11,566,530 B2 * 1/2023 Karakasis ..... F01D 5/141
2003/0228226 A1 * 12/2003 Higashimori ..... F01D 5/141 416/243
2004/0105756 A1 * 6/2004 Higashimori ..... F01D 5/14 415/206
2005/0260074 A1 * 11/2005 Higashimori ..... F04D 21/00 415/206
2007/0243064 A1 * 10/2007 Nakano ..... F04D 29/384 416/63
2008/0260528 A1 * 10/2008 Weber ..... F01D 17/165 415/208.2
2009/0123276 A1 * 5/2009 Greim ..... F01D 5/141 415/193
2009/0220346 A1 * 9/2009 Schluter ..... F04D 29/284 29/889.21
2009/0290980 A1 * 11/2009 Higashimori ..... F02B 37/22 415/205
2010/0098548 A1 * 4/2010 Yokoyama ..... F01D 5/048 416/223 R
2011/0173975 A1 * 7/2011 Sun ..... F04D 29/284 60/605.2
2012/0263599 A1 * 10/2012 Sugimura ..... F04D 29/30 416/223 R
2015/0086396 A1 * 3/2015 Nasir ..... F01D 5/141 417/407
2015/0159670 A1 * 6/2015 Saito ..... F04D 17/122 416/185
2015/0330226 A1 * 11/2015 Yokoyama ..... F01D 25/24 416/235
2016/0076551 A1 * 3/2016 Saito ..... F04D 29/30 415/206
2018/0058468 A1 * 3/2018 Yanagisawa ..... F04D 29/30
2019/0136694 A1 * 5/2019 Yoshida ..... F02B 37/24
2019/0271326 A1 9/2019 Cao et al.
2020/0056487 A1 * 2/2020 Honda ..... F01D 5/021
2020/0088210 A1 * 3/2020 Honda ..... F02B 39/00
2020/0355198 A1 * 11/2020 Honda ..... F04D 29/30
2021/0010478 A1 * 1/2021 Masaki ..... F04D 29/286

FOREIGN PATENT DOCUMENTS

JP 2014-109193 A 6/2014
JP 2016-65548 A 4/2016
JP 2019-152166 A 9/2019

OTHER PUBLICATIONS

Notification Concerning Transmittal of International Preliminary Report on Patentability (Forms PCT/IB/326) issued in counterpart International Application No. PCT/JP2021/016172 dated Nov. 3, 2022, with Forms PCT/IB/373, PCT/IB/338 and PCT/ISA/237. (12 pages).
Office Action dated Jul. 18, 2023, issued in counterpart JP application No. 2022-517072, with English translation. (8 pages).

* cited by examiner

IMPELLER AND CENTRIFUGAL COMPRESSOR

TECHNICAL FIELD

The present disclosure relates to an impeller and a centrifugal compressor.

The present application claims priority based on Japanese Patent Application No. 2020-076704 filed on Apr. 23, 2020, the entire content of which is incorporated herein by reference.

BACKGROUND ART

An impeller used for a centrifugal compressor is equipped with a disk-shaped hub and a plurality of blades disposed on one surface of the hub.

In such an impeller, it is common practice to increase the circumferential component of the absolute flow velocity at the outlet by decreasing the backward angle of the blades in order to improve the pressure ratio. The backward angle is the angle formed by the tangent line at the trailing edge of the blade and the radial direction of the rotational axis. One illustrative example of the impeller having such a shape is disclosed in Patent Document 1.

CITATION LIST

Patent Literature

Patent Document 1: JP2014-109193A.

SUMMARY

Problems to be Solved

However, in the impeller having such a shape, the blade load is uniformly large from the hub to the tips of the blades, resulting in large losses due to flow structures such as secondary flow caused by the pressure gradient inside the impeller and leakage vortices at the blade tips. This may lead to a decrease in efficiency and a reduction in the stable operating area.

The present disclosure was made in view of the above, and an object thereof is to provide an impeller and a centrifugal compressor with high pressure ratio and high efficiency.

Solution to the Problems

To solve the above problem, an impeller according to the present disclosure includes: a disk-shaped hub centered on an axis; and a plurality of blades arranged in the circumferential direction and protruding from a surface of the hub facing one side in the direction of the axis. In a cross-sectional view including a blade height direction from the hub to the tip of each blade, the blade has a recessed surface curved convexly toward the rear side in the rotational direction, and the blade has a portion where the curvature of the recessed surface increases from the leading edge side to the trailing edge side.

Advantageous Effects

According to the present disclosure, it is possible to provide an impeller and a centrifugal compressor with high pressure ratio and high efficiency.

DETAILED DESCRIPTION (Configuration of Centrifugal Compressor)

Figure 1:
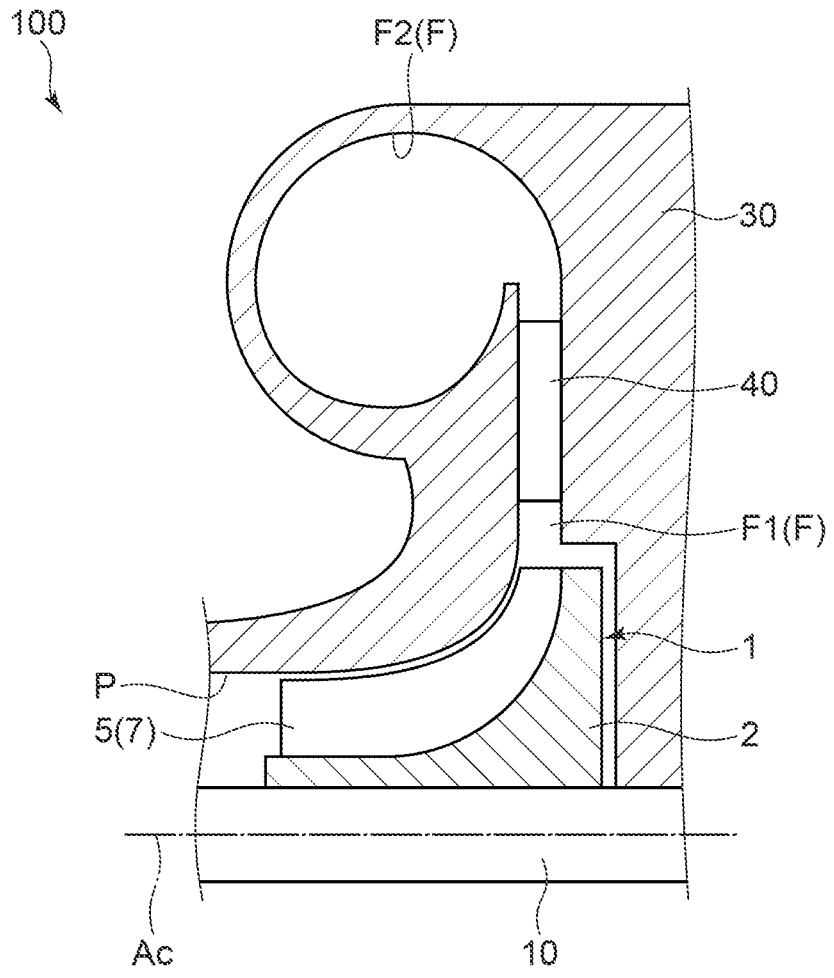
FIG. 1 is a cross-sectional view showing a configuration of a centrifugal compressor according to an embodiment of the present disclosure.

A centrifugal compressor 100 according to embodiments of the present disclosure will now be described with reference to FIGS. 1 to 8. As shown in FIG. 1, the centrifugal compressor 100 is provided with a rotational shaft 10, an impeller 1, a casing 30, and a diffuser vane 40. In the present invention, the diffuser vane 40 is not an essential configuration, and the present invention may be applied to a centrifugal compressor not provided with diffuser vanes.

The rotational shaft 10 extends along the axis Ac and is rotatable around the axis Ac. The impeller 1 is fixed to the outer peripheral surface of the rotational shaft 10. The impeller 1 has a hub 2 and a plurality of blades 5, 7 (full blades 5 and splitter blades 7).

The hub 2 has a disk shape centered on the axis Ac. The outer peripheral surface of the hub 2 has a curved surface shape that curves from inside to outside in the radial direction as it extends from one side to the other side in the direction of the axis Ac.

Figure 2:
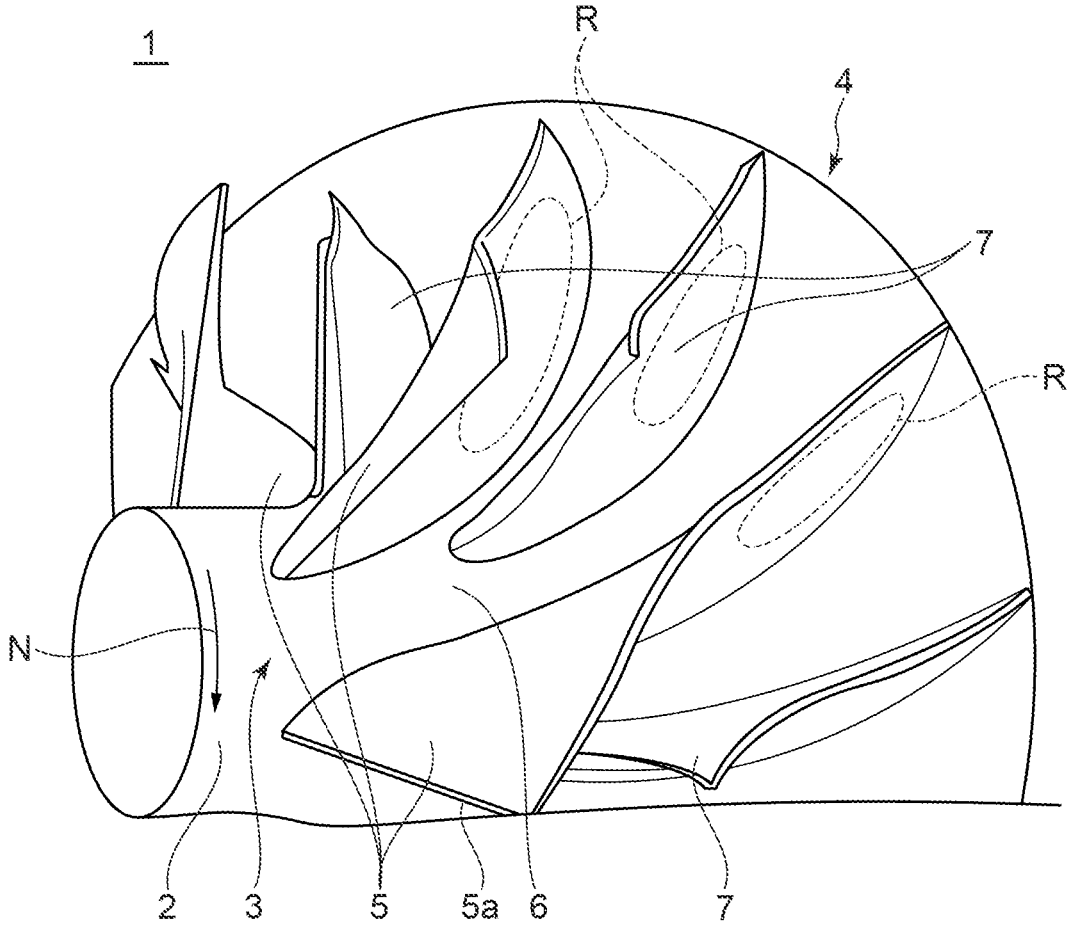
FIG. 2 is a perspective view showing a configuration of an impeller according to an embodiment of the present disclosure.

As shown in FIG. 2, the full blade 5 is a long blade disposed on the peripheral surface of the hub 2 so as to extend from an inlet portion 3 to an outlet portion 4 for a fluid. The splitter blade 7 is a short blade disposed in a passage 6 formed between each adjacent full blades 5 on the peripheral surface of the hub 2 so as to extend from the downstream side of a leading edge 5*a* of the full blade 5 to the outlet portion 4. The arrow (reference numeral N) in FIG. 2 indicates the rotational direction of the impeller 1.

Figure 3:
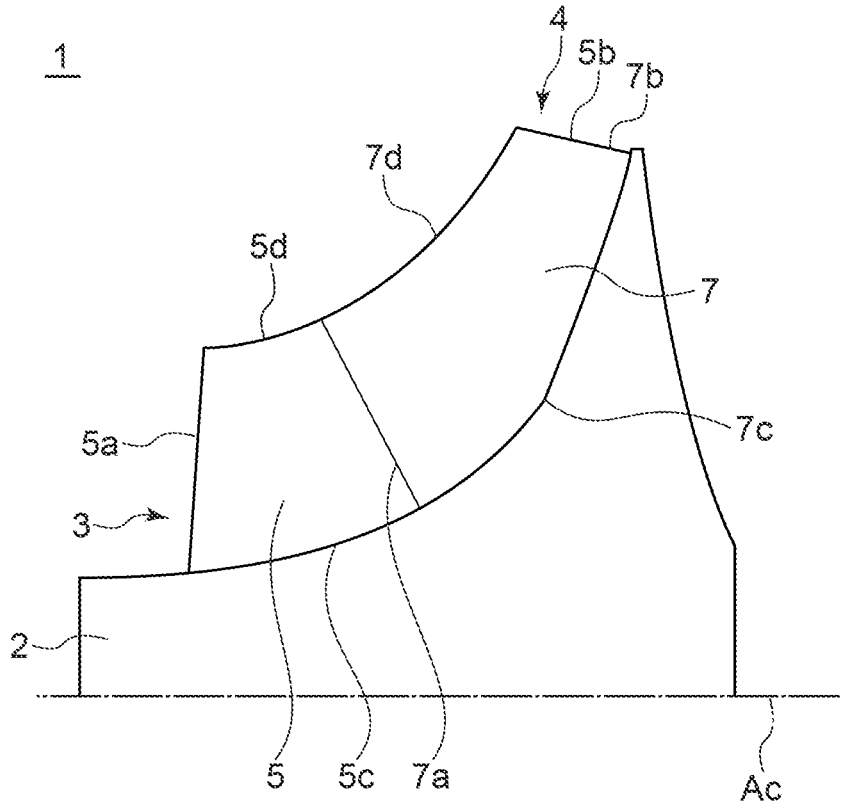
FIG. 3 is a meridian plane view showing a configuration of an impeller according to an embodiment of the present disclosure.

As shown in FIG. 3, the full blade 5 has a leading edge 5*a* which is an edge adjacent to the inlet portion 3, a trailing edge 5*b* which is an edge adjacent to the outlet portion 4, a hub-side edge 5*c* which is an edge on the side connected to the hub 2, and a tip-side edge 5*d* which is an edge opposite to the hub-side edge 5*c*. The splitter blade 7 has a leading edge 7*a* which is an edge adjacent to the inlet portion 3, a trailing edge 7*b* which is an edge adjacent to the outlet portion 4, a hub-side edge 7*c* which is an edge on the side connected to the hub 2, and a tip-side edge 7*d* which is an edge opposite to the hub-side edge 7*c*. Each tip-side edge 5*d*, 7*d* faces the inner wall surface of the casing (not shown), and a gap (hereinafter, referred to as "clearance") is formed between the tip-side edge 5*d*, 7*d* and the inner wall surface of the casing. The detailed configuration of the full blade 5 will be described later.

The casing 30 surrounds the rotational shall 10 and the impeller 1 from the outer peripheral side. Inside the casing 30, a compression passage P for accommodating the impeller 1 and compressing a fluid guided from the outside, and an outlet passage F connected to the radially outer side of the compression passage P are formed.

The diameter of the compression passage P gradually increases from one side to the other side in the axis Ac direction in conformity with the outer shape of the impeller 1. The outlet passage F is connected to the outlet of the compression passage P on the radially outer side.

The outlet passage F has a diffuser passage F1 and an outlet scroll F2. The diffuser passage F1 is provided to recover the static pressure of the fluid guided from the compression passage P. The diffuser passage F1 has an annular shape extending outward in the radial direction from the outlet of the compression passage P. In a cross-sectional view including the axis Ac, the passage width of the diffuser passage F1 is constant over the entire extension direction. A plurality of diffuser vanes 40 may be provided in the diffuser passage F1.

The outlet scroll F2 is connected to the outlet of the diffuser passage F1 on the radially outer side. The outlet scroll F2 has a spiral shape extending in the circumferential direction of the axis Ac. The outlet scroll F2 has a circular passage cross-section. An exhaust hole (not shown) for guiding the high-pressure fluid to the outside is formed in a part of the outlet scroll F2.

(Configuration of Full Blade)

Figure 4:
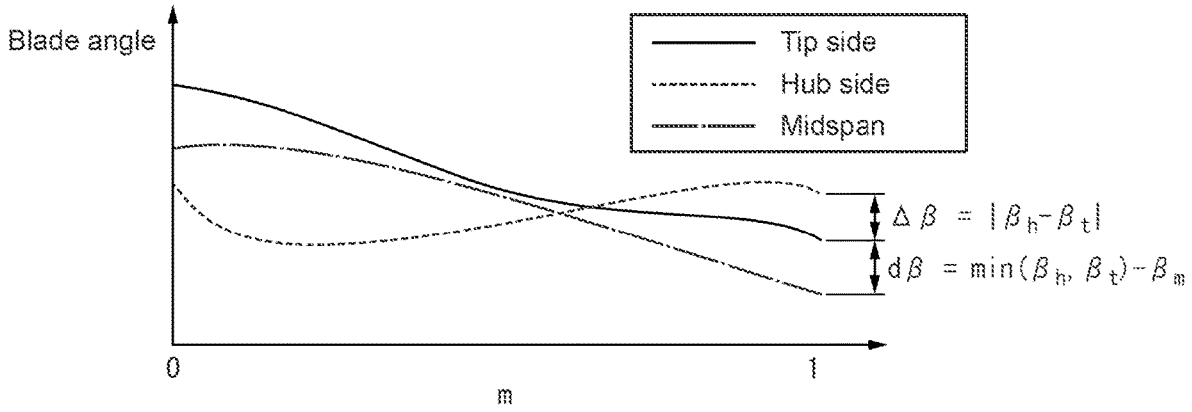
FIG. 4 is a diagram showing a blade angle distribution of an impeller according to an embodiment of the present disclosure.

FIG. 4 shows the distribution of the blade angles of the hub-side edge 5*c* and the tip-side edge 5*d* of the full blade 5 from the leading edge 5*a* to the trailing edge 5*b*. In FIG. 4, the axis of ratio m of a length in the meridional length direction of the full blade 5 from the leading edge 5*a* of the full blade 5 to the meridional length of the full blade 5 is taken in the meridional length direction of the full blade 5. From the definition of m, m=0 for the position of the leading edge 5*a* and m=1 for the position of the trailing edge 5*b*, 7*b*. The fact that the value of m is the same means that the position when the impeller 1 is viewed from the meridional direction is the same. In FIG. 4, the solid line indicates the blade angle distribution of the tip-side edge 5*d*, the dashed line indicates the blade angle distribution of the hub-side edge 5*c*, and the dotted and dashed line indicates the blade angle distribution of a portion (midspan 5*m*) between the tip-side edge 5*d* and the hub-side edge 5*c*. Here, when the position of the hub-side edge 5*c* in the blade height direction is 0% spanwise position and the position of the tip-side edge 5*d* is 100% spanwise position, the position of the midspan 5*m* in FIG. 4 is 50% spanwise position (intermediate position between the tip-side edge 5*d* and the hub-side edge 5*c*). However, in the present invention, the position of the midspan 5*m* is not limited to 50% spanwise position. The position of a recessed surface R, which will be described later, may be defined, with the position of the midspan 5*m* being any spanwise position within the range of 30 to 70% spanwise position.

Figure 6:
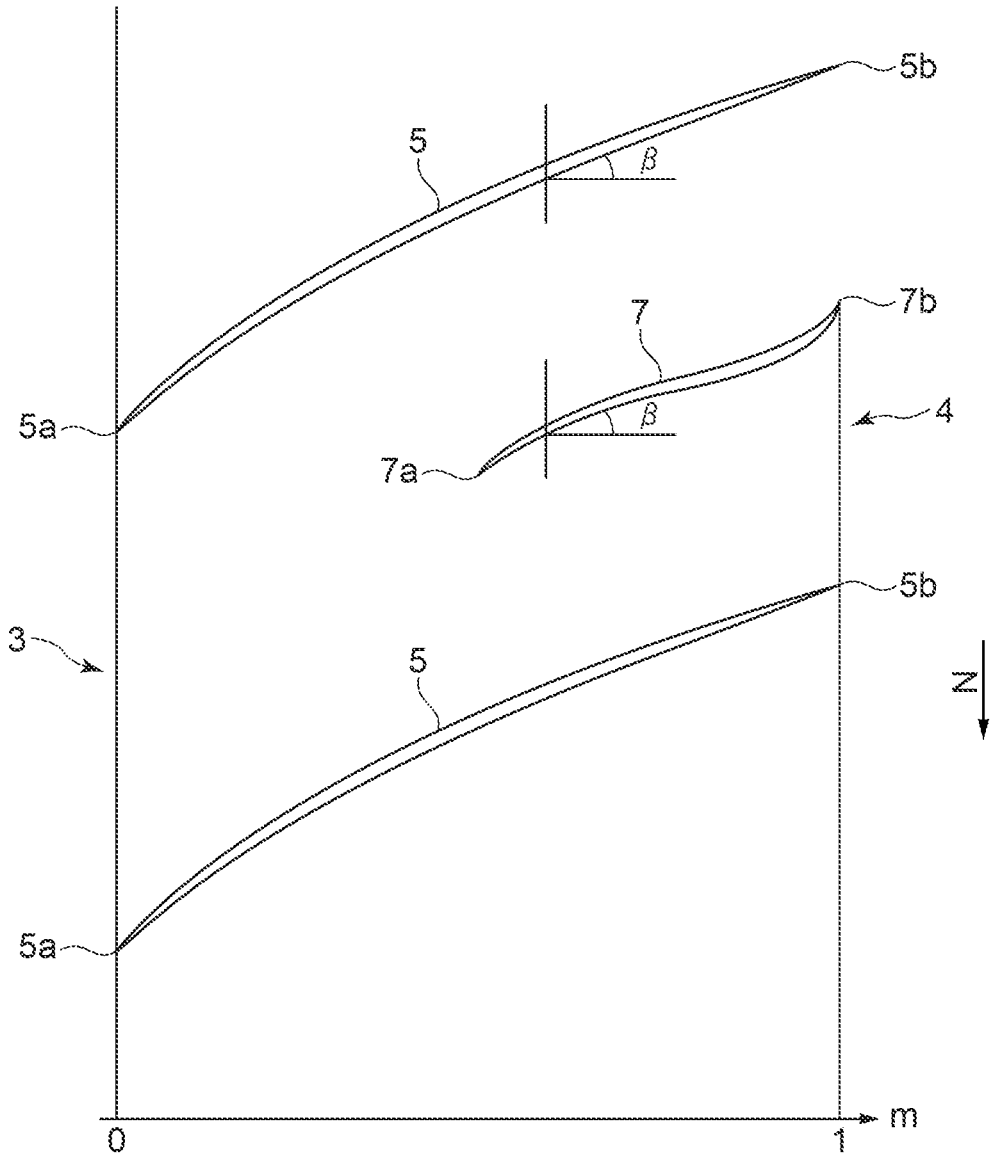
FIG. 6 is a diagram for defining the blade angle of blades according to an embodiment of the present disclosure.
Figure 7:
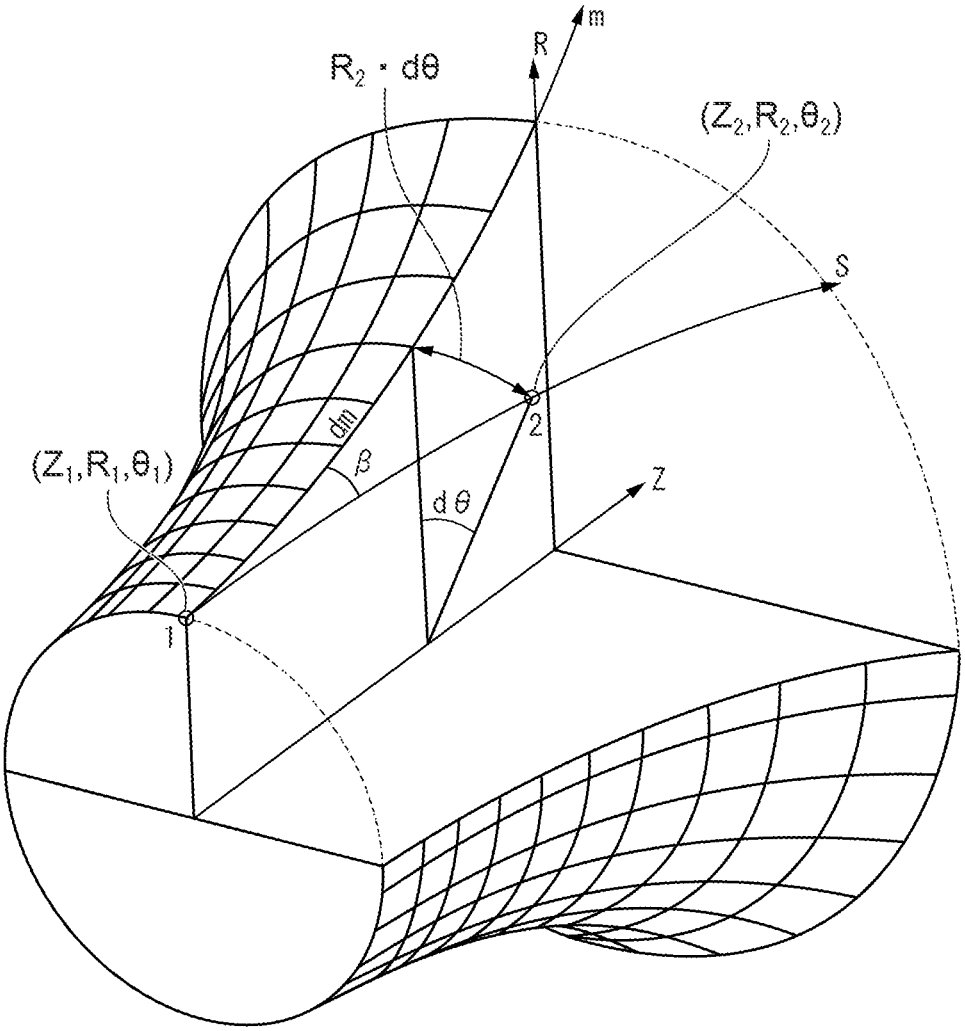
FIG. 7 is an explanatory diagram showing a relationship between the blade angle and the camber line of a full blade according to an embodiment of the present disclosure.

FIG. 6 is a developed view of the blade 5 on a plane from the inlet portion 3 to the outlet portion 4 along the meridional length direction at any spanwise position of the blade 5. In this developed view, the vertical axis represents the rotational direction of the blade 5, and the horizontal axis represents the meridional length direction. On this plane, the angle β formed by the blade (full blade 5 or splitter blade 7) and the meridional length direction is defined as the blade angle. That is, the blade angle β in the position of the trailing edge of the blade (backward angle) is the angle formed by the tangent line to the blade surface at the trailing edge of the blade and the meridional length direction. Further, referring to FIG. 7, in the coordinate system represented by the axial direction z, the radial direction R, and the rotation angle θ around the axis, the blade angle β in the small interval between the coordinate point 1 and the coordinate point 2 is defined by the following equation (1).

$$\tan \beta = R2 \cdot d\theta / dm \quad (1)$$

Here, $d\theta = \theta 2 - \theta 1$, $dm = \sqrt{(Z_2 - Z_1)^2 + (R_2 - R_1)^2}$, and S is the camber line.

In the embodiment shown in FIG. 4, in the full blade 5, on the leading edge 5*a* side, the blade angle βt of the tip-side edge 5*d* is the largest, followed by the blade angle βm of the midspan 5*m*. Further, on the leading edge 5*a* side, the blade angle βh of the hub-side edge 5*c* is the smallest (βt>βm>βh). On the other hand, the blade angle distribution changes from the leading edge 5*a* side to the trailing edge 5*b* side. Specifically, on the trailing edge 5*b* side, the blade angle βh of the hub-side edge 5*c* is the largest, followed by the blade angle βt of the tip-side edge 5*d*. Further, on the trailing edge 5*b* side, the blade angle βm of the midspan 5*m* is the smallest (βh>βt>βm).

In an embodiment not shown, on the trailing edge 5*b* side, the blade angle βt of the tip-side edge 5*d* may be the largest. Further, the blade angle βt of the tip-side edge 5*d* may be equal to the blade angle βh of the hub-side edge 5*c*. Also in this case, on the trailing edge 5*b* side, the blade angle βm of the midspan 5*m* is the smallest (βt≥βh>βm).

Figure 5A:
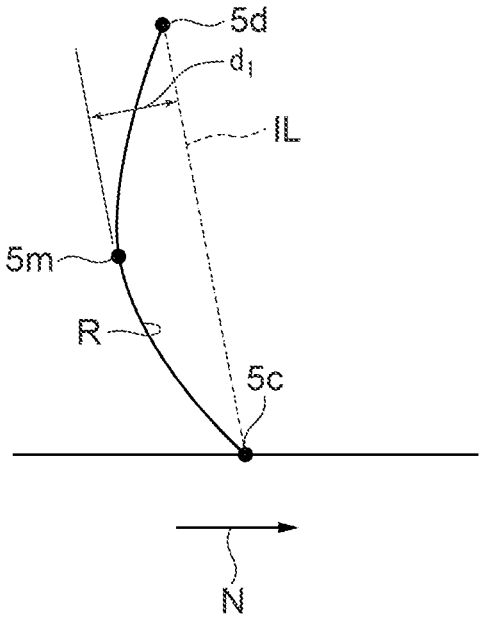
FIG. 5A is a diagram showing the shape of a full blade in the blade height direction according to an embodiment of the present disclosure.
Figure 5B:
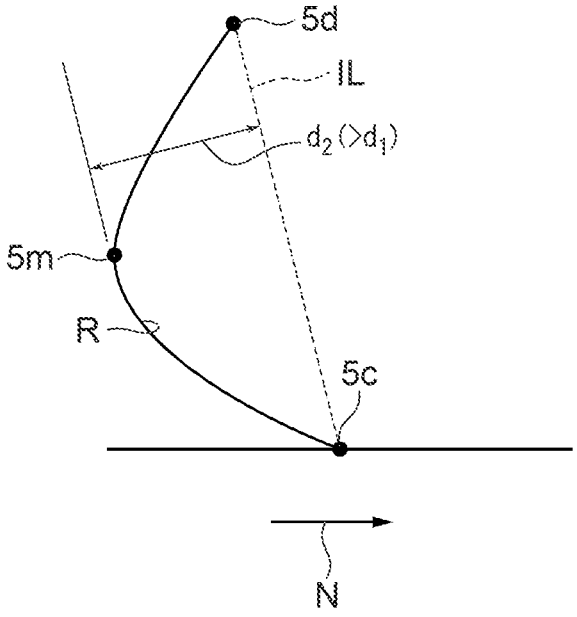
FIG. 5B is a diagram showing the shape of a full blade in the blade height direction according to an embodiment of the present disclosure.

FIGS. 5A and 5B are each a diagram showing the shape of the blade in the blade height direction according to an embodiment of the present disclosure. FIGS. 5A and 5B show the shape (blade thickness center line) of the full blade in a portion ranging from 40 to 100% (m=0.4 to 1.0) from the leading edge, and FIG. 5A is closer to the leading edge 5*a* than FIG. 5B.

That is, as shown in FIGS. 2, 5A, and 5B, the blade angle distribution of FIG. 4 means that the blade 5 according to the present embodiment has a recessed surface R curved convexly toward the rear side in the rotational direction N a cross-sectional view including the blade height direction which is a direction away from the hub 2 toward the tip.

Further, in the cross-sectional view, when a distance between an imaginary line IL connecting the tip-side edge 5*d* and the hub-side edge 5*c* of the full blade 5 and the midspan of the blade along a direction perpendicular to the imaginary line is defined as a recess amount d, the full blade 5 has a portion where the recess amount d increases from the leading edge 5*a* side to the trailing edge 5*b* side ($d_2 > d_1$). The recess amount $d_2$ at the midspan 5*m* in FIG. 5B is larger than the recess amount $d_1$ at the midspan 5*m* in FIG. 5A.

Further, as can be seen from FIG. 4, the full blade 5 has a portion where the curvature of the recessed surface R increases from the leading edge 5*a* side to the trailing edge 5*b* side. The curvature of the recessed surface R at the midspan 5*m* in FIG. 5B is larger than the curvature of the recessed surface R at the midspan 5*m* in FIG. 5A. Here, the curvature of the recessed surface R is defined as the reciprocal of the radius of curvature of the minimum imaginary circle that touches the recessed surface R at least two points.

The recessed surface R is preferably formed in at least part of a portion that is 40 to 100% (m=0.4 to 1.0) from the leading edge 5*a* of the full blade 5. Further, the recessed surface R is preferably formed in at least a portion that is 60% (m=0.6) from the leading edge 5*a*, where the secondary flow on the blade surface is particularly strong. Further, the portion of the recessed surface R with the largest curvature is preferably formed in a portion that is 60 to 70% (m=0.6 to 0.7) from the leading edge 5*a* of the full blade 5.

In the full blade 5 according to the present embodiment, as described above, in the position of the trailing edge 5*b* of the full blade 5, the blade angle βm at the midspan 5*m* is smaller than the blade angle βh on the hub side and the blade angle βt on the tip side.

Further, in the full blade 5 according to the present embodiment, as shown in FIG. 4, in the position of the trailing edge 5*b* of the full blade 5, a relationship of dβ>Δβ is satisfied, where dβ is a difference between the smaller one (min (βh, βt)) of the blade angle βh on the hub side or the blade angle βt on the tip side and the blade angle βm at the midspan 5*m*, and Δβ is an absolute value (|βh−βt|) of a difference between the blade angle βh on the hub side and the blade angle βt on the tip side. Preferably, a relationship of dβ>Δβ+2° is satisfied. More preferably, a relationship of dβ>Δβ+5° is satisfied.

(Operation and Effect)

Figure 8:
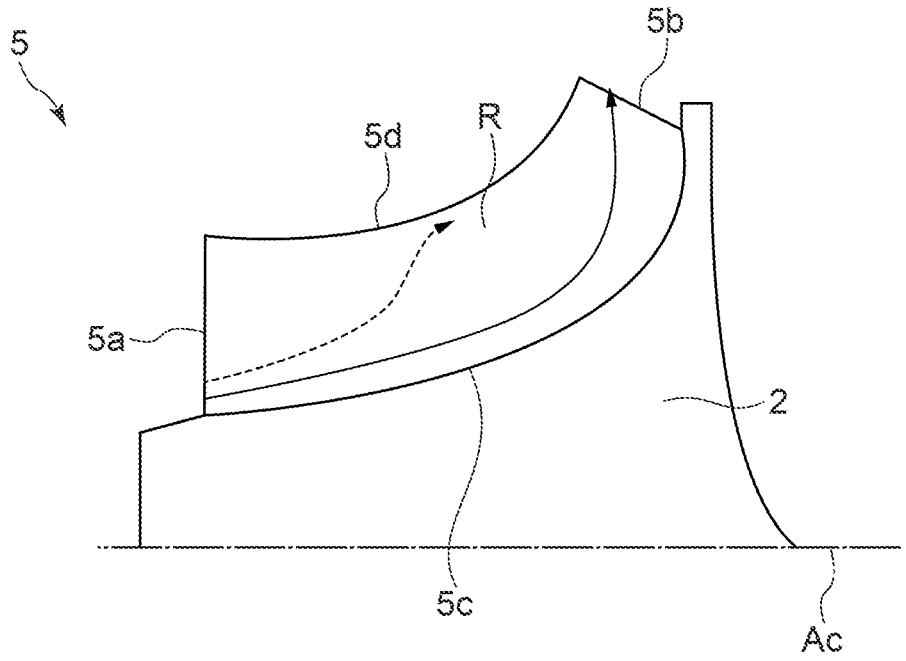
FIG. 8 is an explanatory diagram showing the state of secondary flow of an impeller according to an embodiment of the present disclosure.

According to the above configuration, the full blade 5 has a recessed surface R curved convexly toward the rear side in the rotational direction. Further, the full blade 5 has a portion where the recess amount d increases from the leading edge 5*a* side to the trailing edge 5*b* side ($d_2>d_1$). As shown in FIG. 8, when a fluid flows along the full blade 5, the flow is actively drawn toward the recessed surface R. As a result, the secondary flow is captured by the recessed surface R and guided toward not the tip-side edge 5*d* but the trailing edge 5*b* (the solid line in FIG. 8). On the other hand, if there is no recessed surface R, as shown by the dashed arrow, the secondary flow flows from the leading edge 5*a* toward the tip-side edge 5*d* due to centrifugal force. As a result, the loss increases. In contrast, according to the present embodiment, it is possible to reduce the loss due to such a secondary flow. Thus, with the above configuration, the compression ratio of the impeller 1 can be increased by the amount that dβ is larger than Δβ.

Here, it is known that the secondary flow is likely to occur in a portion that is 40 to 100% from the leading edge of the blade, particularly a portion near 60% from the leading edge. With the above configuration, since the recessed surface is formed in a portion where the secondary flow is likely to occur, the secondary flow can be reduced actively.

According to the above configuration, in the position of the trailing edge 5*b* of the full blade 5, the blade angle βm of the midspan 5*m* is smaller than the blade angle βh on the hub side and the blade angle βt on the tip side. Further, as described above, a relationship of dβ>Δβ is satisfied. Preferably, a relationship of dβ>Δβ+2° is satisfied. More preferably, a relationship of dβ>Δβ+5° is satisfied.

Thus, the compression ratio of the impeller 1 can be increased by the amount dβ is larger than Δβ.

Other Embodiments

Embodiments of the present disclosure have been described specifically with reference to the drawings, but the specific configuration is not limited to these embodiments. Various modifications can be made without departing from the object of the present disclosure. For example, in the above-described embodiments, the case where the recessed surface R is formed on the full blade 5 has been described as an example, but the recessed surface R may be formed on the splitter blade 7.

<Appendix>

The impeller 1 and the centrifugal compressor 100 described in the above embodiments would be understood as follows, for instance.

(1) An impeller 1 according to the first aspect includes: a disk-shaped hub 2 centered on an axis Ac; and a plurality of blades 5 arranged in a circumferential direction and protruding from a surface of the hub 2 facing one side in a direction of the axis Ac. In a cross-sectional view including a blade height direction which is a direction away from the hub 2 toward a tip of each blade 5, the blade 5 has a recessed surface R curved convexly toward a rear side in a rotational direction. In the cross-sectional view, when a distance between an imaginary line IL connecting a tip-side edge 5*d* and a hub-side edge 5*c* of the blade 5 and a midspan 5*m* of the blade 5 along a direction perpendicular to the imaginary line IL is defined as a recess amount d, the blade 5 has a portion where the recess amount d increases from a leading edge side to a trailing edge side.

According to the above configuration, the blade 5 has a recessed surface curved convexly toward the rear side in the rotational direction. Further, the blade 5 has a portion where the recess amount d increases from the leading edge 5*a* side to the trailing edge 5*b* side. When a fluid flows along the blade 5, the flow is actively drawn toward the recessed surface R. As a result, the secondary flow is captured by the recessed surface R and guided toward not the tip but the trailing edge 5*b*. Consequently, the loss due to the secondary flow can be reduced, and the compression ratio of the impeller 1 can be increased.

(2) In the impeller 1 according to the second aspect, the portion where the recess amount d increases is configured such that a curvature of the recessed surface R increases from the leading edge side to the trailing edge side.

With the above configuration, since the portion where the recess amount d increases is configured such that the curvature of the recessed surface R increases from the leading edge side to the trailing edge side, the loss due to the secondary flow can be reduced more effectively, and the compression ratio of the impeller 1 can be increased.

(3) In the impeller 1 according to the third aspect, in a position of the trailing edge 5*b* of the blade 5, a blade angle βm at the midspan 5*m* between the hub-side edge 5*c* and the tip-side edge 5*d* of the blade 5 is smaller than a blade angle βh on the hub side and a blade angle βt on the tip side.

With the above configuration, since the backward angle (blade angle at trailing edge) of the midspan 5*m* is small compared to the hub 2 and the shroud, the pressure ratio can be improved without changing the load near the wall surface such as the hub 2 and the shroud, which are closely related to the secondary flow and leakage flow, as much as possible (while suppressing the pressure loss due to the flow structure as much as possible).

(4) In the impeller 1 according to the fourth aspect, the recessed surface R is formed in a portion that is 40 to 100% from the leading edge of the blade 5.

Here, it is known that the secondary flow is likely to occur particularly in a portion that is 40 to 100% from the leading edge 5*b* of the blade 5. With the above configuration, since the recessed surface R is formed in a portion where the secondary flow is likely to occur, the secondary flow can be reduced actively.

(5) In the impeller 1 according to the fifth aspect, in the third aspect, in a position of the trailing edge 5*a* of the blade 5, a relationship of $d\beta>\Delta\beta$ is satisfied, where $d\beta$ is a difference between the smaller one of the blade angle $\beta h$ on the hub side or the blade angle $\beta t$ on the tip side and the blade angle $\beta m$ at the midspan, and $\Delta\beta$ is an absolute value of a difference between the blade angle $\beta h$ on the hub side and the blade angle $\beta t$ on the tip side.

With the above configuration, it is possible to improve the effect described in the third aspect (3).

(6) In the impeller 1 according to the sixth aspect, in the fifth aspect (5), a relationship of $d\beta>\Delta\beta+2°$ is satisfied.

With the above configuration, it is possible to further improve the effect described in the third aspect (3).

(7) A centrifugal compressor 100 according to the seventh aspect includes an impeller 1 and a casing 30 covering the impeller.

With the above configuration, it is possible to provide a centrifugal compressor with high pressure ratio and improved efficiency.

REFERENCE SIGNS LIST

100 Centrifugal compressor
1 Impeller
2 Hub
3 Inlet portion
4 Outlet portion
5 Full blade
5*a* Leading edge
5*b* Trailing edge
5*c* Hub-side edge
5*d* Tip-side edge
5*m* Midspan
6 Passage
7 Splitter blade
10 Rotational shaft
30 Casing
40 Diffuser vane
Ac Axis
F Outlet passage
F1 Diffuser passage
F2 Outlet scroll
P Compression passage
R Recessed surface
P1 Plane

The invention claimed is:

1. An impeller, comprising:

a disk-shaped hub centered on an axis; and a plurality of blades arranged in a circumferential direction and protruding from a surface of the hub facing one side in a direction of the axis, wherein, in a cross-sectional view including a blade height direction which is a direction away from the hub toward a tip of each blade, the blade has a recessed surface curved convexly toward a rear side in a rotational direction, wherein, in the cross-sectional view, when a distance between an imaginary line connecting a tip-side edge and a hub-side edge of the blade and a midspan of the blade along a direction perpendicular to the imaginary line is defined as a recess amount, the blade has a portion where the recess amount increases from a leading edge side to a trailing edge side, and wherein, in a position of the trailing edge of the blade, a blade angle at the midspan is smaller than a blade angle on the hub side and a blade angle on the tip side.

2. The impeller according to claim 1, wherein the portion where the recess amount increases is configured such that a curvature of the recessed surface increases from the leading edge side to the trailing edge side.

3. The impeller according to claim 1, wherein the recessed surface is formed in at least part of a portion that is 40% to 100% from the leading edge of the blade.

4. The impeller according to claim 1, wherein, in a position of the trailing edge of the blade, a relationship of $d\beta>\Delta\beta$ is satisfied, where $d\beta$ is a difference between the smaller one of the blade angle on the hub side or the blade angle on the tip side and the blade angle at the midspan, and $\Delta\beta$ is an absolute value of a difference between the blade angle on the hub side and the blade angle on the tip side.

5. The impeller according to claim 4, wherein a relationship of $d\beta>\Delta\beta+2°$ is satisfied.

6. A centrifugal compressor, comprising:

the impeller according to claim 1; and a casing covering the impeller.

* * * * *